US007610721B1

(12) United States Patent
Frelier

(10) Patent No.: US 7,610,721 B1
(45) Date of Patent: Nov. 3, 2009

(54) RAIN GUTTER DRAINAGE AND DEBRIS REMOVAL SYSTEM

(76) Inventor: Calvin A. Frelier, 15 Old Westfall Dr., Rochester, NY (US) 14625

( * ) Notice: Subject to any disclaimer, the term of this patent is extended or adjusted under 35 U.S.C. 154(b) by 0 days.

(21) Appl. No.: 12/002,265

(22) Filed: Dec. 17, 2007

Related U.S. Application Data

(63) Continuation-in-part of application No. 11/807,966, filed on Jun. 1, 2007, now Pat. No. 7,428,799.

(51) Int. Cl.
*E04D 13/00* (2006.01)

(52) U.S. Cl. ..... 52/11; 52/12; 52/13; 52/14; 52/15; 15/236.04; 15/1; 401/289

(58) Field of Classification Search ..... 52/11–16; 15/1, 236.04, 401; 401/289; 210/162–164, 210/496, 497.1; 209/627, 385, 387; 119/166, 119/442, 447, 451
See application file for complete search history.

(56) References Cited

U.S. PATENT DOCUMENTS 2,817,867 A * 12/1957 Bugbird ..... 15/172
2,896,239 A * 7/1959 Bugbird ..... 15/144.1
3,023,971 A * 3/1962 Milhous ..... 401/137
4,310,940 A * 1/1982 Moore ..... 15/105
4,750,883 A * 6/1988 Drake ..... 401/137
4,978,241 A * 12/1990 Lawson ..... 401/118
5,357,719 A * 10/1994 Lewis ..... 52/11
D353,189 S * 12/1994 Crowley ..... D23/267
5,802,774 A * 9/1998 Kardacz ..... 52/11
5,867,945 A * 2/1999 Scafidi ..... 52/16
6,139,077 A * 10/2000 Molzan, II ..... 294/19.1
2004/0060142 A1* 4/2004 Hubbard ..... 15/236.04

* cited by examiner

*Primary Examiner*—Brian E Glessner
*Assistant Examiner*—James J Buckle, Jr.
(74) *Attorney, Agent, or Firm*—Robert J. Bird

(57) ABSTRACT

In summary, this invention is a rain gutter debris removal system, including a rain gutter and a debris removal device operable within the gutter. The gutter includes a back wall and a bottom channel member. The debris removal device includes an upright scavenging blade mounted within and lengthwise of the channel for movement between a home position retracted against the back wall, and an extended forward position across the channel. An actuator moves the scavenging blade between home and extended positions, whereby to expel debris from the channel. The scavenging blade includes a wiper blade along its bottom for wiping engagement with the gutter channel. The actuator includes a reciprocable expansible chamber device positioned between the back wall and the scavenging blade, and connected to the back wall for pivotal movement up and down, the wiper blade thereby maintaining wiping engagement with the gutter channel as the blade traverses the channel. A system having a number of these devices will include remote control to selectively operate the several devices.

3 Claims, 6 Drawing Sheets

RAIN GUTTER DRAINAGE AND DEBRIS REMOVAL SYSTEM

CROSS REFERENCE TO RELATED APPLICATION

This is a continuation-in-part of my application Ser. No. 11/807,966 which was filed Jun. 1, 2007 now U.S. Pat. No. 7,428,799.

BACKGROUND INFORMATION

This invention is a rain gutter system, and more specifically a rain gutter system with means to eject accumulated debris from the gutter.

Conventional rain gutter systems include generally horizontal gutters to collect water from a roof surface, and vertical downspouts to drain water from the gutters to the ground below. A problem with such gutters is that they also accumulate debris such as leaves, seeds, needles, cones, and the like. These accumulations must be removed from time to time, and this is typically done manually by someone standing on a ladder.

U.S. Pat. No. 7,152,376 issued Dec. 26, 2006 to Wyatt discloses a rain gutter system in which gutters are tilt-able forward to dump accumulated debris. Wyatt is the most relevant prior art that I know of.

SUMMARY OF THE INVENTION

In summary, this invention is a rain gutter debris removal system, including a rain gutter and a debris removal device operable within the gutter. The gutter includes a back wall and a bottom channel member. The debris removal device includes an upright scavenging blade mounted within and lengthwise of the channel for movement between a home position retracted against the back wall, and an extended forward position across the channel. An actuator moves the scavenging blade between home and extended positions, whereby to expel debris from the channel. The scavenging blade includes a wiper blade along its bottom for wiping engagement with the gutter channel. The actuator includes a reciprocable expansible chamber device positioned between the back wall and the scavenging blade, and connected to the back wall for pivotal movement up and down, the wiper blade thereby maintaining wiping engagement with the gutter channel as the blade traverses the channel. A system having a number of these devices will include remote control to selectively operate the several devices.

BRIEF DESCRIPTION OF THE DRAWINGS

The following description of the preferred embodiment of this invention is given with reference to the accompanying drawings, in which.

DETAILED DESCRIPTION OF THE INVENTION

Figure 1A:
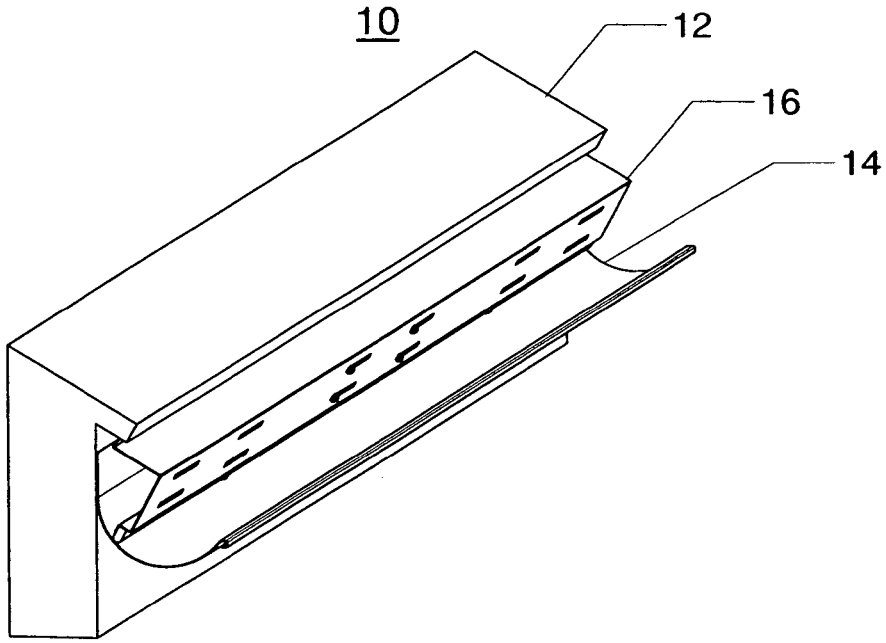
FIG. 1*a* is a left front perspective view of my drainage debris removal system, normally closed, in a rounded gutter.

With reference now to the drawing figures:

FIG. 1*a* shows an integrated gutter clearing device 10 applied to a rounded gutter profile. The gutter clearing device 10 is intended for mounting to a structure 12, typically at the bottom of a sloped roof to collect and conduct rainwater away from the structure and its foundation.

Roof drainage systems tend to collect and accumulate debris from the roof within the drainage channel. Reliable function of the gutter requires periodic clearing of debris to prevent clogging.

Figure 1B:
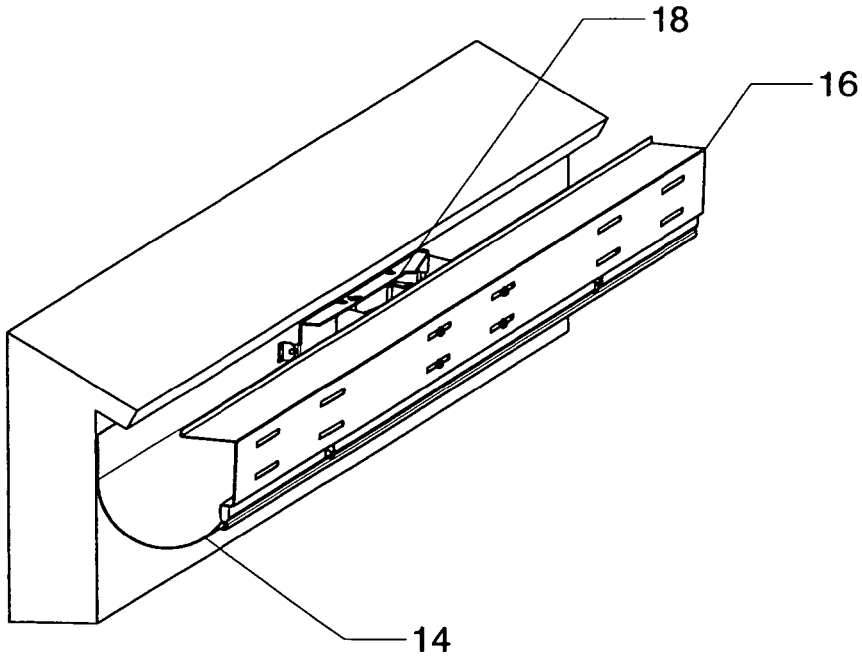
FIG. 1*b* is similar to FIG. 1*a*, with the debris removal system in an open position.

The gutter clearing device 10, best seen in FIGS. 1*a* and 1*b*, includes a rounded gutter section 14 including a back wall section 2.5" high and a rounded section of approximate radius 3.75" and a sweep of 140° concluding with an open rectangular section at the end of the curve. The gutter is aluminum, 0.05" thick, and is fixed to supporting structure by suitable spaced fasteners, not shown.

The gutter section 14 may be formed from a roll in a single piece of required length, or in sections which are abutted and sealed at their joints.

Figure 2A:
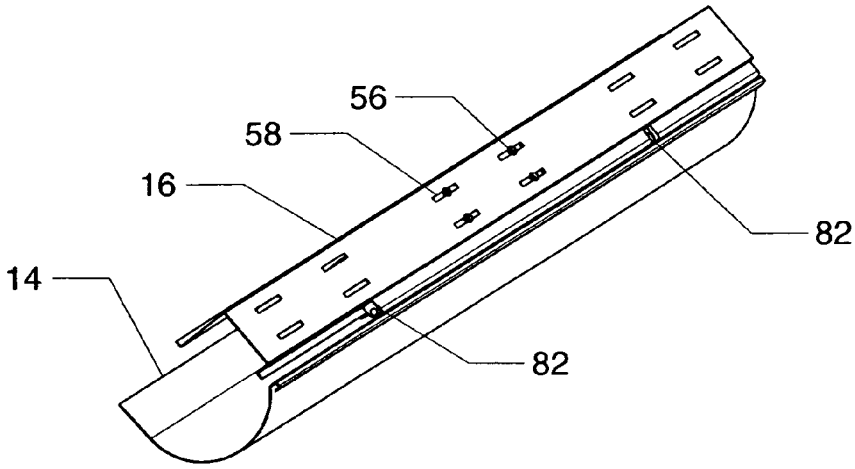
FIG. 2*a* is a left bottom perspective view of a scavenger blade in the open position.

In FIG. 2 a scavenging blade 16 is loosely connected to the channel span 38 (FIG. 5*a*) of an actuation assembly 18 (FIGS. 5*a*, 5*b*) by multiple standoffs 56 (FIGS. 2*a*, 5*a*) which allow lateral movement of the scavenging blade 16 relative to the channel span 38. The scavenging blade 16 is aluminum, 0.05" thick, 4.25" high, and 3.1" deep. It includes multiple slots 58 to support the blade 16 on the actuation assembly 18, and to allow lateral displacement of the underlying channel span 38 relative to the blade 16. The scavenging blade 16 is preferably in sections about 118" long, but cut to shorter lengths as required.

Figure 2B:
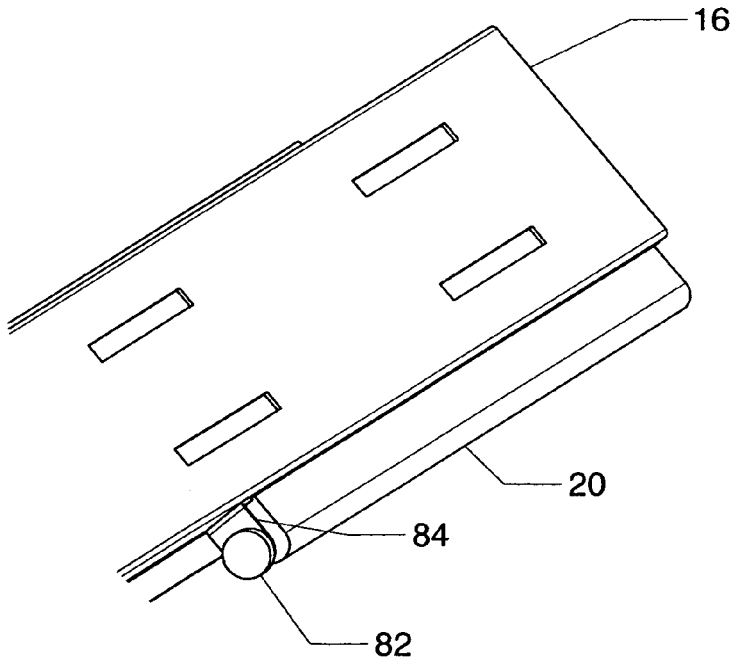
FIG. 2*b* is a lower left perspective view of a scavenger blade, roller, and wiper.

In FIG. 2*b*, a bottom roller 82 is mounted on a roller bracket 84 on the bottom of the scavenging blade 16. The roller 82 provides a small clearance between gutter 14 and scavenging blade 16 to reduce friction during operation of the device.

A wiper 20 is suitably fixed along the bottom of the scavenging blade. The wiper 20, which may be a flexible foam or a brush, provides the sweeping action, by which material is swept from the interior of the gutter section 14.

Figure 3A:
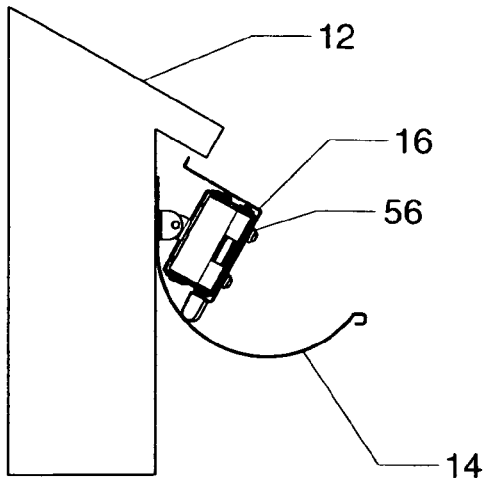
FIG. 3*a* is a side view of my drainage debris removal system, in its normally closed position.
Figure 3B:
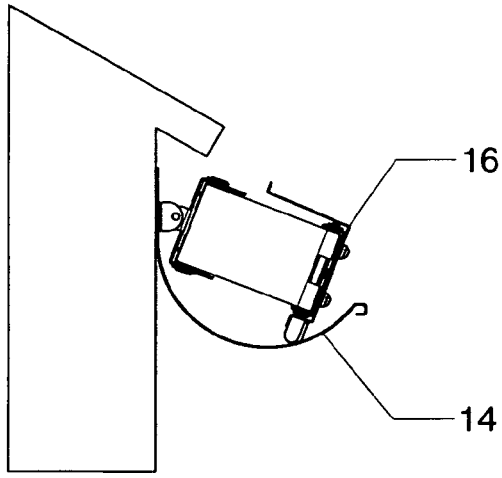
FIG. 3*b* is similar to FIG. 3*a*, with debris removal in process.
Figure 3C:
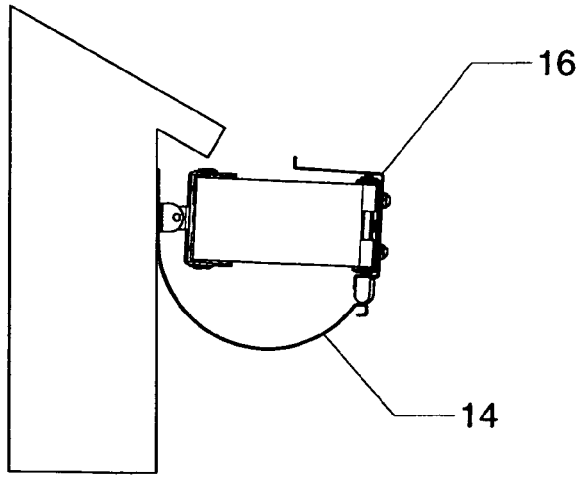
FIG. 3*c* is similar to FIG. 3*b*, showing completion of debris removal.

FIGS. 3*a*-3*c* depict positions of the scavenging blade 16 relative to the gutter 14 as it advances through a gutter clearing operation.

Figure 4A:
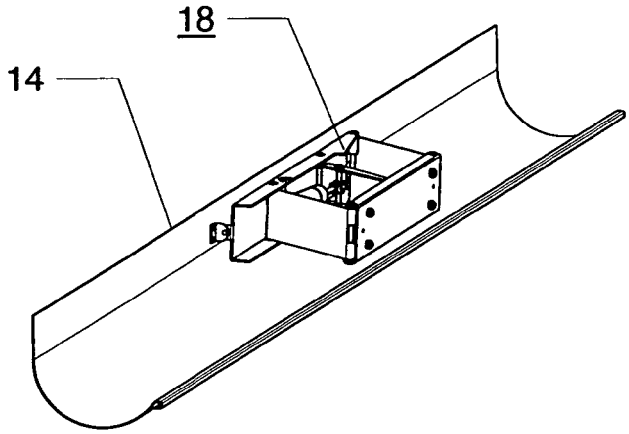
FIG. 4*a* is a left front perspective view of a pivotally mounted actuator assembly.
Figure 4B:
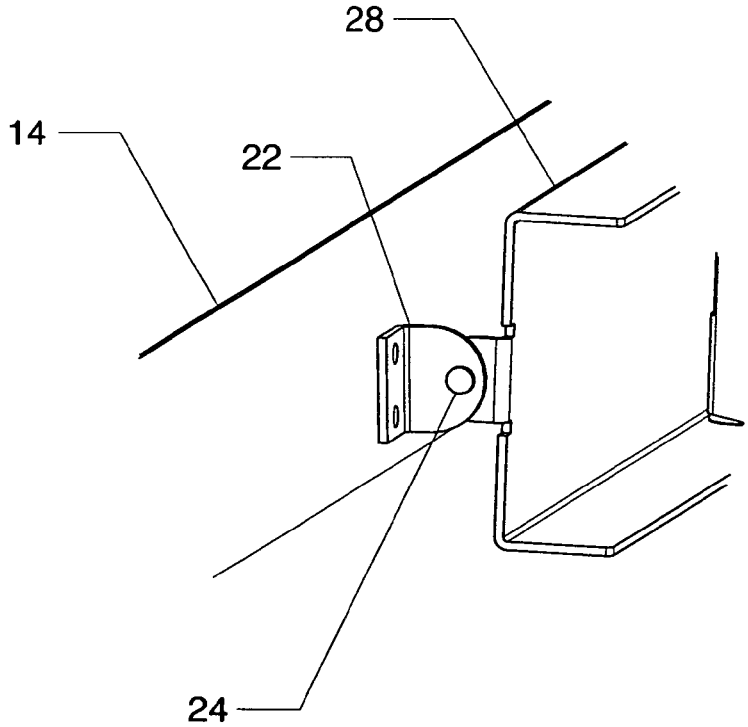
FIG. 4*b* is a left front perspective view of actuator assembly mounting details.
Figure 5A:
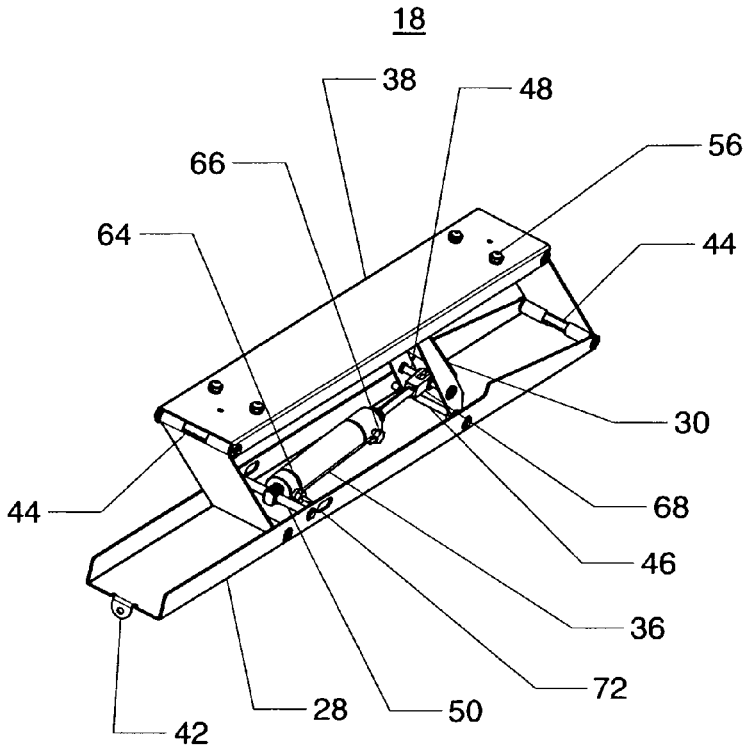
FIG. 5*a* is a perspective view from above of an actuator assembly.

In FIG. 4 an actuation assembly 18 (see also FIGS. 5*a*, 5*b*) is pivotally connected to a pivot bracket 22 in the gutter 14 by a pivot shaft 24 on the back side of the actuator base plate 28 (FIG. 5*a*). There is a pivot bracket 22 at each end of the actuator base plate 28. Pivot bracket 22 is suitably fixed to the gutter structure 12.

Figure 5B:
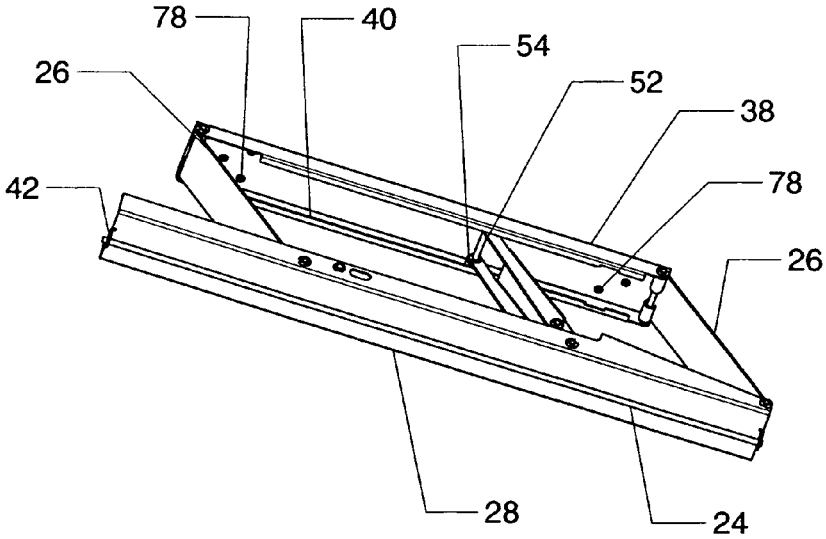
FIG. 5*b* is a perspective view from below of an actuator assembly.

Actuation assembly 18 includes the following components best seen in FIGS. 5*a*, 5*b*.

Actuator base plate 28 is of aluminum, 0.08" thick and 30" long with upward formed sides 1" high for a length of 24". The remaining 6" of length of upward formed sides rise to a height of 1.5" and decline at an angle of 7° toward the end of the actuator base plate 28. A series of holes are located in the sidewalls of the actuator base plate to accommodate bearings and shafts. Tab with hole 42 is constructed at each end to support the actuation assembly 18 and to accommodate pivotal motion.

Channel span 38 is of aluminum, 0.06" thick with formed channel 40 running along its length on both sides. Formed channel 40 forms a path for orbital roller 54. The channel span 38 is 21.3" long and 3.1" wide with channel sections 0.7" across in cross section. Pemsert nut 78 is pressed onto channel span 38. Pemsert nuts 78 provide mounting locations for standoff feature 56.

Hinge plate 26 is of stainless steel, 0.07" thick with rolled ends similar to a typical door hinge. Hinge plate 26 is 8" long when measuring from the center of one rolled feature to the other. The hinge plate 26 is 3" wide.

Actuation Arm 30 is of aluminum, 0.1" thick, and includes a central smaller plate and two longer formed sides extending from the plate at 90°. The actuation arm 30 is 7.6" long, 2.2" wide, and 1.2" high (max).

Actuation arm pivot shaft 46 is pivotally fixed to actuator base plate 28 and actuation arm 30. Actuation arm pivot shaft is of stainless steel, 2.8" long and 0.25" diameter.

Air cylinder 36 is primarily of stainless steel and aluminum, 1.125" diameter and 3" stroke. Air cylinder 36 motivates debris removal in the system. Air cylinder 36 alternately opens and closes the actuation assembly. A rod clevis 68 connects the rod end of the cylinder 36 to the pneumatic forcing shaft 48 to actuation arm 30.

Pneumatic fixed shaft 50 is a cross member shaft which pivotally connects air cylinder 36 to actuator base plate 28. The shaft 50 is of stainless steel, 3.5" long and 0.316" diameter.

Orbital Shaft 52 is pivotally attached at the end of actuation arm 30 with an orbital roller 54 at each end. Orbital shaft 52 is of stainless steel, 2.785" long and 0.25" diameter. Orbital Roller 54 is 0.68" in diameter and 0.31" wide with a centrally located hole of 0.251" diameter and a recessed area 0.55" in diameter and 0.18" deep to permit the end of orbital shaft to not to protrude beyond the outer edge of orbital roller 54 while it is pivotally fixed to orbital shaft 52. Orbital roller 54 is retained at each end of orbital shaft 52 by internal retaining rings (not shown). Orbital roller 54 runs within formed channel 40 of channel span 38 during actuation of air cylinder 36. The orbital roller 54 might be injection molded polycarbonate plastic, nylon, or other polymeric material.

Hinge plate 26 is a metal plate with hinge features 0.375" in diameter located at each end 8 inches apart. Hinge plate 26 is of stainless steel 2.88" wide.

Hinge plate shafts 44 pivotally connect hinge plates 26 to the actuator base plate 28 and to the channel span 38. Hinge plate shafts 44 are of stainless steel, 3.475" long and 0.25" diameter. Common bushings radially position the shafts 44 within the hinge plate 26.

The combination of actuator base plate 28 linked to channel span 38 by hinge plates 26 creates what is commonly known as a four bar linkage in which the channel span 38 remains parallel to the actuator base plate 28 during articulation of the actuation arm 30.

The air hose is connected to the actuation assembly 18 through an opening 72 in the sidewall of actuator base plate 28. Air hose opening 32 which is connected to straight pneumatic fitting 64, when pressurized in the absence of an equal or higher pressure in air hose closing 34 connected to angled pneumatic fitting 66, causes actuation assembly 18 to open.

Multiple actuators can by linked to operate simultaneously by connecting air hose opening 32 and air hose closing 34 to respective common sources of air pressure. Therefore two series of connected air hoses 32 and 34, linking all of the actuation assemblies in a given drainage system can exist. One for driving the removal of debris and one for driving the closing of the system after debris has been evacuated.

Pneumatic line actuator opening 32 is routed to the actuation assembly 18 and enters through an opening 72 and is connected to straight pneumatic fitting 64.

Pneumatic line actuator closing 34 is routed to the actuation assembly 18 and enters through an opening 72 in the sidewall of actuator base plate 28 and is connected to angled pneumatic fitting 66.

Induced air pressure in pneumatic line 32, with venting to atmosphere of pneumatic line 34, causes actuation assembly 18 to actuate into its open position and drive scavenging blade 16 to expel debris. When pneumatic line 34 is pressurized and pneumatic line 32 is allowed to vent to atmospheric pressure, actuation assembly 18 is motivated to the closed or home position.

Substitution of an electrical linear actuator for a pneumatic actuator is anticipated.

Figure 6:
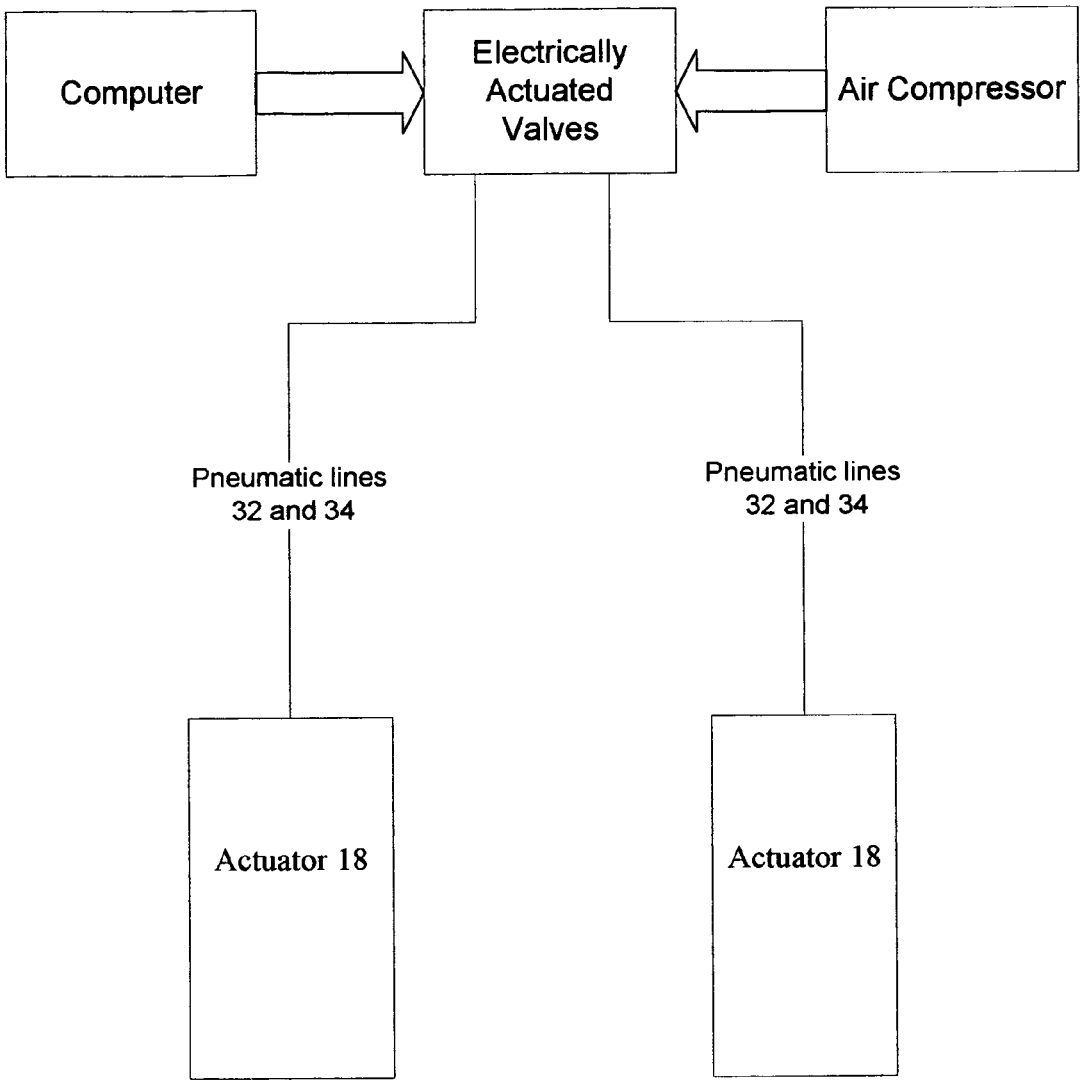
FIG. 6 is a Block Diagram describing remote and independent control of several integrated drainage and debris removal systems.

FIG. 6 illustrates a control system approach for independently controlling more than one system by independently controlling the pressure to the pneumatic lines 32 and 34 for each system. In this case the term system could refer to a single unit or it could represent several units linked to common pneumatic lines 32 and 34. Therefore it is possible for example to expel debris from gutter sections located in a given section of a structure independently of other sections. FIG. 6 envisions using a computer to independently control valves to manage operation of actuators.

Dimensions in the foregoing description are given as examples, not as limitations of this invention.

PARTS LIST

| | |
|---|---|
| 10 | Gutter Clearing Device |
| 12 | Structure |
| 14 | Gutter Section |
| 16 | Scavenging Blade |
| 18 | Actuation Assembly |
| 20 | Wiper |
| 22 | Pivot Bracket |
| 24 | Pivot Shaft |
| 26 | Hinge Plate |
| 28 | Actuator Base Plate |
| 30 | Actuation Arm |
| 32 | Pneumatic line |
| 34 | Pneumatic line |
| 36 | Air Cylinder |
| 38 | Channel Span |
| 40 | Formed Channel |
| 42 | Tab with hole |
| 44 | Hinge Plate Shaft |
| 46 | Actuation Arm Pivot shaft |
| 48 | Pneumatic Forcing Shaft |
| 50 | Pneumatic Fixed Shaft |
| 52 | Orbital Shaft |
| 54 | Orbital Roller |
| 56 | Standoff Feature |
| 58 | Slot |
| 64 | Straight Pneumatic Fitting |
| 66 | Angled Pneumatic Fitting |
| 68 | Rod Clevis |
| 72 | Opening |
| 78 | Pemsert Nut |

-continued

| PARTS LIST | |
|---|---|
| 82 | Roller |
| 84 | Roller Bracket |
| 86 | Roller shaft |

What is claimed is:

1. A rain gutter debris removal system, including a rain gutter and a gutter clearing device in operative engagement with said gutter; said gutter including a back wall section and a bottom gutter section defining a channel therealong; said gutter clearing device including an upright scavenging blade disposed lengthwise within said channel for movement between a home position, retracted toward said back wall, and an extended position across said channel, forward of said back wall; and actuator means to reciprocate said scavenging blade between said home position and said extended position thereof, whereby to expel debris from said channel; said actuator means including a reciprocable expansible chamber device disposed between said back wall and said scavenging blade and pivotally connected to said back wall for pivotal movement up and down, whereby said wiper blade maintains wiping engagement with said gutter as said wiper blade traverses said channel.

2. The system defined in claim 1, said scavenging blade including a wiper blade along the bottom thereof for wiping engagement with said channel of said bottom member.

3. A plurality of rain gutter debris removal systems, each said system including a rain gutter and a gutter clearing device in operative engagement with said gutter; said gutter including a back wall section and a bottom gutter section defining a channel therealong; said gutter clearing device including an upright scavenging blade disposed lengthwise within said channel for movement between a home position, retracted toward said back wall, and an extended position across said channel, forward of said back wall; actuator means to reciprocate said scavenging blade between said home position and said extended position thereof, whereby to expel debris from said channel; said actuator means including a reciprocable expansible chamber device disposed between said back wall and said scavenging blade and pivotally connected to said back wall for pivotal movement up and down, whereby said wiper blade maintains wiping engagement with said gutter as said wiper blade traverses said channel; and remote control means operatively connected to each of said actuators to selectively control the operation thereof.

* * * * *